US005235143A

United States Patent [19]

Bahjat et al.

[11] Patent Number: 5,235,143

[45] Date of Patent: Aug. 10, 1993

[54] ELEVATOR SYSTEM HAVING DYNAMICALLY VARIABLE DOOR DWELL TIME BASED UPON AVERAGE WAITING TIME

[75] Inventors: Zuhair S. Bahjat, Farmington; V. Sarma Pullela, North Granby, both of Conn.

[73] Assignee: Otis Elevator Company, Farmington, Conn.

[21] Appl. No.: 799,503

[22] Filed: Nov. 27, 1991

[51] Int. Cl.[5] ..... B66B 13/02; B66B 13/10

[52] U.S. Cl. ..... 187/103; 187/130

[58] Field of Search ..... 187/124, 125, 101, 100, 187/103, 104, 121, 130; 358/113

[56] References Cited

U.S. PATENT DOCUMENTS

| | | | |
|---|---|---|---|
| 2,847,089 | 8/1958 | Santini | 187/125 |
| 3,580,360 | 5/1971 | Keiper | 187/125 |
| 3,891,064 | 6/1975 | Clark . | |
| 4,193,478 | 3/1980 | Keller et al. | 187/101 |
| 4,323,142 | 4/1982 | Bittar . | |
| 4,363,381 | 12/1982 | Bittar . | |
| 4,473,134 | 9/1984 | Uetani | 187/124 |
| 4,523,665 | 6/1985 | Tsuji . | |
| 4,524,418 | 6/1985 | Araya et al. . | |
| 4,672,531 | 6/1987 | Uetani | 187/124 |
| 4,930,603 | 6/1990 | Brenner | 187/125 |
| 5,001,557 | 3/1992 | Begle | 358/113 |
| 5,024,295 | 6/1991 | Thangavelu . | |

OTHER PUBLICATIONS

"Lift Supervisory Control Systems", G. C. Barney et al.

*Lift-Traffic Analysis Design and Control*, Pub. P. Peregrinus Ltd., Chap. 3, pp. 85-147.

*Primary Examiner*—Steven L. Stephan
*Assistant Examiner*—Robert Nappi
*Attorney, Agent, or Firm*—Maguire, Jr., Francis J.; Joseph P. Abate

[57] ABSTRACT

Disclosed are me and apparatus for establishing a Door Dwell Time for an elevator car. The method includes the steps of (a) accumulating, over a first interval of time, a total amount of time that expires between a time when a hall call is received to when an elevator door of the elevator car opens in response to the hall call; and, at the end of the interval of time, (b) determining an Average Waiting Time (AWT) by dividing the total amount of time by a number of hall calls that occurred during the first interval of time. The method further includes the steps of (c) comparing the AWT to a first AWT threshold value; and, if the AWT exceeds the first AWT threshold value, (d) decreasing the elevator car Door Dwell Time (DDT) by a time increment so as to obtain a revised DDT for use during a second time interval. If the AWT does not exceed the first AWT threshold value, the method further includes the steps of (e) comparing the AWT to a second AWT threshold value; and if the AWT is less than the second AWT threshold value, (f) increasing the elevator car DDT by the time increment so as to obtain a revised DDT for use during the second time interval.

20 Claims, 2 Drawing Sheets

ELEVATOR SYSTEM HAVING DYNAMICALLY VARIABLE DOOR DWELL TIME BASED UPON AVERAGE WAITING TIME

CROSS REFERENCE TO A RELATED PATENT APPLICATION

This patent application is related to a commonly assigned U.S. patent application entitled "CONTROLLING DOOR DWELL TIME BASED ON TRAFFIC CONDITIONS" Ser. No. 07/672,547, filed Aug. 20, 1991, by V. Pullela et al.

TECHNICAL FIELD

This invention relates to elevator systems and, in particular, to a method and apparatus for dynamically varying the elevator Door Dwell Time as a function of Average Waiting Time.

BACKGROUND OF THE INVENTION

Modern elevator systems often include distributed intelligence in the form of elevator car controllers, such as microprocessors.

In an elevator system the door of each elevator car is usually maintained open for a set period of time to allow passenger(s) to either board and/or deboard. The time period for which the system maintains the door open before a command to close is given is termed the "Door Dwell Time." An exemplary range of values for a fixed, pre-set dwell time is within a range of approximately four to six seconds.

In present elevator systems the amount of time an elevator car's doors are kept open is either hard-wired in the system, or is entered as constant numbers or as variables in electrically erasable, programmable read-only memory (EEPROM). This memory is coupled to a microprocessor controlling the door motion of the elevator cage. These selected parameters remain constant or static (unless changed on-site by human intervention during, for example, maintenance) for the life of the equipment.

The only Door Dwell Time difference that is standard in known types of conventional elevator systems is that hall calls and car calls are distinguished from one another. There is also an assumption that only one passenger will deboard for each car call and that only one passenger will board for each hall call. The preset dwell time for a hall call may be four seconds, while the preset dwell time for a car call is typically less than four seconds, since less time is typically needed to exit a car than to get to the car from an outside location.

However, a static or operationally fixed door dwell time may be insufficient for the traffic at hand, causing the doors to be prematurely commanded to close while passengers are still boarding and/or deboarding. This causes a "door reversal" to take place, when the closing doors make contact with one or more passengers, further wasting time and often slowing down the transferring traffic.

In commonly assigned U.S. Pat. No. 4,363,381, issued Dec. 14, 1982, entitled "Relative System Response Elevator Call Assignments" to J. Bittar there is described an elevator system in which hall calls registered at a plurality of landings are assigned to cars on the basis of a summation of relative system response factors for each car relative to each registered hall call. A discussion of door operation is made in columns 16 and 17.

In U.S. Pat. No. 4,193,478, issued Mar. 18, 1980, entitled Elevator Control System and Method", V. Keller et al. describe at column 8, line 61, to column 7, line 3, the operation of a door routine that is said to include options for different lengths of time or "door times" that elevator doors are allowed to stand open. The door times are selected depending upon what type of call has been answered or whether a direct signal to open the door has been initiated. The various programmable door times are said to be under software control. There is no indication in Keller that the door times are other than fixed, preprogrammed door times.

It is an object of this invention to provide an elevator system that employs a determination of Average Waiting Time to dynamically vary Door Dwell Time.

SUMMARY OF THE INVENTION

The foregoing and other problems are overcome and the object of the invention is realized with a method for dynamically varying an elevator Door Dwell Time based upon an Average Waiting Time determination, and with apparatus for accomplishing the method.

The invention operates in a similar manner as a closed loop control system, wherein an actual value of the Door Dwell Time is continuously compared against a desired value and corrected if necessary. As traffic intensity and volume varies over the day, the door dwell times also vary, providing optimum service times and waiting times throughout the day.

The invention determines an Average Waiting Time continuously for predetermined intervals of time. The Average Waiting Time is defined to be a summation of Waiting Times, each Waiting Time being a time from which a hall call is registered to a time at which an elevator door is commanded to open at the hall call landing, divided by the total number of hall calls responded to by the elevator cars of the group during the interval of time. In a preferred embodiment each interval is five minutes. If the Average Waiting Time, for a given interval of time, is greater than a threshold value, the Door Dwell Time is decreased, and if the Average Waiting Time is less than a threshold value, the Door Dwell Time is increased. Limits are imposed so as to prevent the Door Dwell Time from becoming excessively long or excessively short. The end result is to maintain the Average Waiting Time between predetermined limits.

In accordance with a method of establishing a Door Dwell Time for an elevator car, there are disclosed the steps of (a) determining, over a first interval of time, an average amount of time that expires between a time when a hall call is received to when an elevator door of the elevator car is commanded to open in response to the hall call; and (b) determining, in accordance with the average amount of time, a value of the Door Dwell Time for use during a subsequent, second interval of time.

More specifically, there is disclosed a method for establishing a Door Dwell Time for an elevator car. The method comprises the steps of (a) accumulating, over a first interval of time, a total amount of time that expires between a time when a hall call is received to when an elevator door of the elevator car opens in response to the hall call; and, at the end of the interval of time, (b) determining an Average Waiting Time (AWT) by dividing the total amount of time by a number of hall calls that occurred during the interval of time. The method further includes the steps of (c) comparing the AWT to a first AWT threshold value; and, if the AWT exceeds the first AWT threshold value, (d) decreasing the elevator car Door Dwell Time (DDT) by a time increment so as to obtain a revised DDT for use during a second time interval. If the AWT does not exceed the first AWT threshold value, the method further includes the steps of (e) comparing the AWT to a second AWT threshold value; and if the AWT is less than the second AWT threshold value, (f) increasing the elevator car DDT by the time increment so as to obtain a revised DDT for use during the second time interval.

The step of decreasing is followed by a step of determining if the decreased Door Dwell Time is equal to or less than a predetermined minimum Door Dwell Time and, if so, increasing the Door Dwell Time so that it equals or exceeds the minimum Door Dwell Time.

In a similar fashion, the step of increasing is followed by a step of determining if the increased Door Dwell Time is equal to or greater than a predetermined maximum Door Dwell Time and, if so, decreasing the Door Dwell Time so that it equals or is less than the maximum Door Dwell Time.

BRIEF DESCRIPTION OF THE DRAWINGS

The foregoing aspects of the invention will be made more apparent in the ensuing Detailed Description when read in conjunction with the accompanying drawings, wherein.

DETAILED DESCRIPTION OF THE INVENTION

The disclosure of commonly assigned U.S. Pat. No. 4,363,381, issued Dec. 14, 1982, entitled "Relative System Response Elevator Call Assignments" to J. Bittar is incorporated herein by reference in its entirety.

Figure 1:
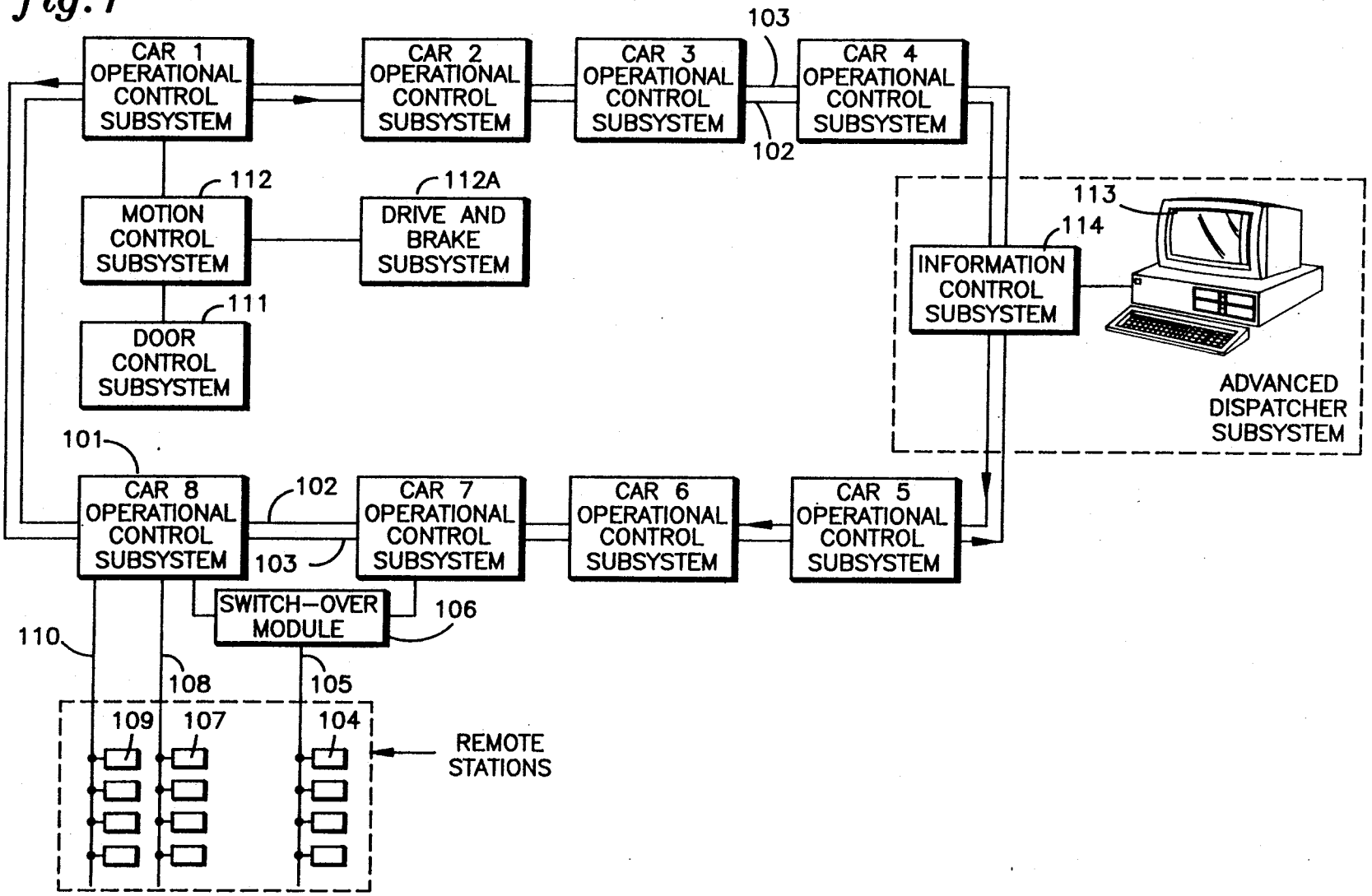
FIG. 1 is a block diagram of an elevator system that is constructed and operated in accordance with the invention.

FIG. 1 is a block diagram that depicts an elevator system of a type described in co-pending and commonly assigned U.S. patent application Ser. No. 07/029,495, entitled "Two-Way Ring Communication System for Elevator Group Control", filed Mar. 23, 1987. This elevator system presents but one suitable configuration for practicing the present invention. As described therein, an elevator group control function may be distributed to separate data processors, such as microprocessors, on a per elevator car basis. These microprocessors, referred to herein as operational control subsystems (OCSS) 101, are coupled together with a two-way ring communication bus (102, 103). For the illustrated embodiment the elevator group consists of eight elevator cars (CAR 1-CAR 8) and, hence, includes eight OCSS 101 units.

For a given installation, a building may have more than one group of elevator cars. Furthermore, each group may include from one to some maximum specified number of elevator cars, typically a maximum of eight cars.

Hall buttons, for initiating elevator hall calls, and lights are connected with remote stations 104 and remote serial communication links 105 to each OCSS 101 via a switch-over module (SOM) 106. Elevator car buttons, lights, and switches are coupled through similar remote stations 107 and serial links 108 to the OCSS 101. Elevator car specific hall features, such as car direction and position indicators, are coupled through remote stations 109 and a remote serial link 110 to the OCSS 101.

It should be realized that each elevator car and associated OCSS 101 has a similar arrangement of indicators, switches, communication links and the like, as just described, associated therewith. For the sake of simplicity only those associated with CAR 8 are shown in FIG. 1.

Car load measurement is periodically read by a door control subsystem (DCSS) 111, which is a component of a car controller system. The load measurement is sent to a motion control subsystem (MCSS) 112, which is also a component of the car controller system. The load measurement in turn is sent to the OCSS 101. DCSS 111 and MCSS 112 are preferably embodied within microprocessors for controlling the car door operation and the car motion, under the control of the OCSS 101. The MCSS 112 also works in conjunction with a drive and brake subsystem (DBSS) 112A.

A car dispatching function is executed by the OCSS 101, in conjunction with an advanced dispatcher subsystem (ADSS) 113, which communicates with each OCSS 101 through an information control subsystem (ICSS) 114. By example, the measured car load is converted into boarding and deboarding passenger counts by the MCSS 112 and sent to the OCSS 101. The OCSS 101 subsequently transmits this data over the communication buses 102, 103 to the ADSS 113, via the ICSS 114. Also by example, data from a hardware sensor mounted on the car's door frame may sense boarding traffic, and this sensed information is provided to the car's OCSS 101.

As such, it can be seen that the ICSS 114 functions as a communication bus interface for the ADSS 113, which in turn influences high level elevator car control functions and parameters.

The ADSS 113 may also collect data on individual car and group demands throughout the day to arrive at a historical record of traffic demands for different time intervals for each day of the week. The ADSS 113 may also compare a predicted demand to an actual demand so as to adjust elevator car dispatching sequences to obtain an optimum level of group and individual car performance.

Figure 2:
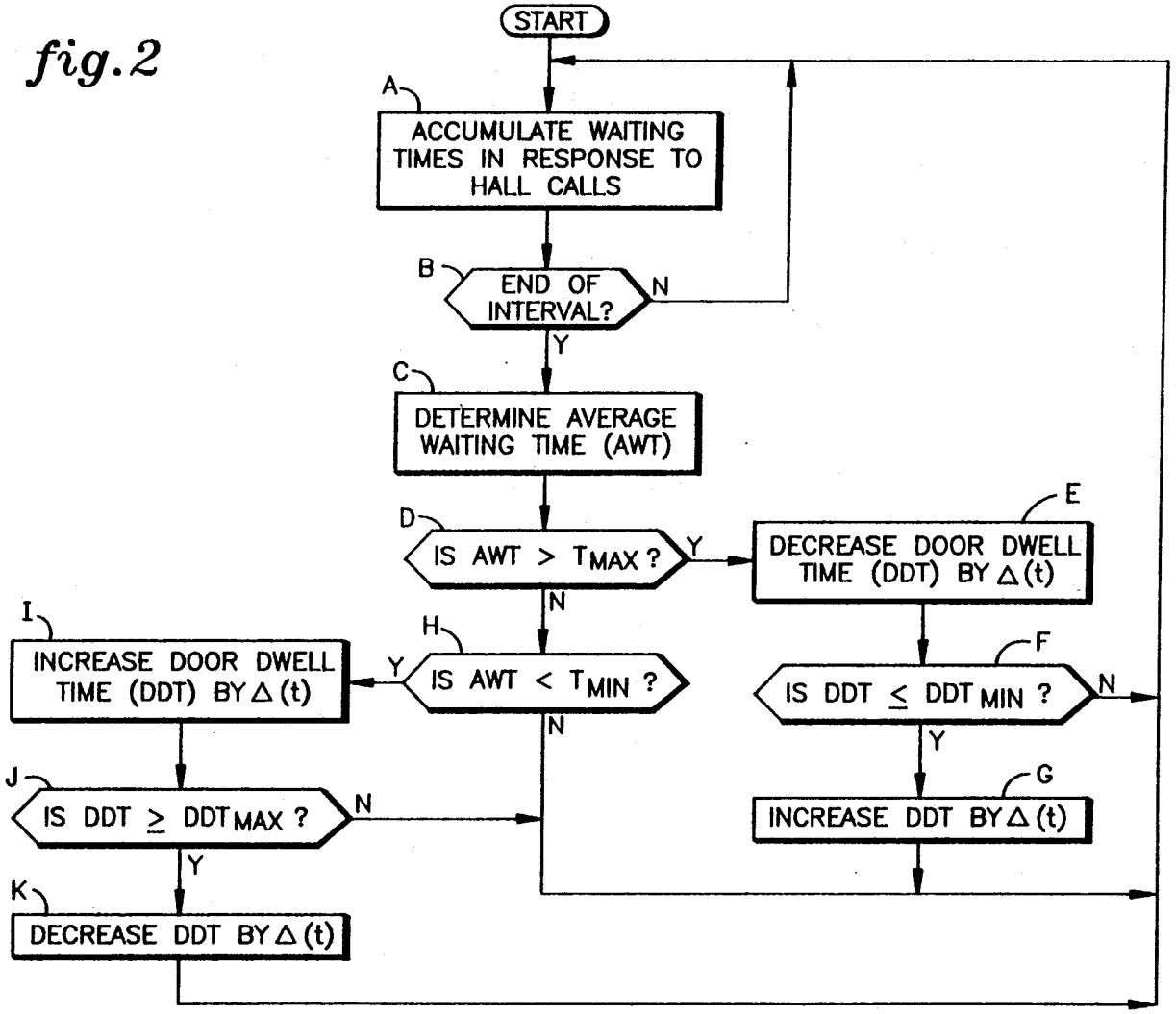
FIG. 2 is a logic flow diagram that illustrates a method of the invention for determining Door Dwell Time.

Various aspects of this functionality are described in commonly assigned U.S. Pat. No. 5,024,295, issued Jun. 19, 1991, entitled "Relative System Response Elevator Dispatcher System using Artificial Intelligence to Vary Bonuses and Penalties" to K. Thangavelu, the disclosure of which is incorporated herein in its entirety. In this commonly assigned U.S. Patent the use of historically based and real-time predictions of elevator group loading are accomplished by a group controller 17 (FIGS. 1 and 2). It should be realized that this same functionality may be accomplished by the ADSS 113 in the elevator system architecture herein depicted in FIG. 1.

Having thus set forth the functionality of the exemplary elevator system of FIG. 1, a detailed description of the operation of the invention is now provided.

Generally, the invention determines an Average Waiting Time continuously for predetermined intervals of time. The Average Waiting Time is defined to be a summation of Waiting Times, each being a time from which a hall call is registered by the OCSS 101 to a time at which the elevator door opens at the hall call landing, divided by the total number of hall calls responded to by the elevator cars of the group during the interval of time. In a preferred embodiment each interval is five minutes, although other interval periods may be employed. If the Average Waiting Time, for a given interval of time, is greater than a first, maximum, threshold value, the Door Dwell Time is decreased, and if the Average Waiting Time is less than a second, minimum, threshold value, the Door Dwell Time is increased. Limits are imposed so as to prevent the Door Dwell Time from becoming excessively long or excessively short and, hence, from adversely impacting system performance.

As employed herein, the Door Dwell Time is considered to be the time that expires between a time that the elevator door is commanded to open, and the time that the elevator door is commanded to close.

Referring now to the logic flow diagram of FIG. 2 the method of the invention is described in greater detail.

At Block A each OCSS 101 accumulates during a predetermined interval, for example five minutes, a total Waiting Time. Each Waiting Time is the time from the registration of a hall call to the time that the elevator door of the associated elevator car is commanded to open at the hall call landing. During this first interval of time some Door Dwell Time value(s) are in effect, such as, for an initial interval of time, default values that are preprogrammed into the OCSS 101. The OCSS 101 periodically determines at Block B if the present interval has expired. If NO, the OCSS re-enters Block A. Of course, during this time the OCSS 101 is also performing other elevator-control related operations.

If, at Block B, it is determined that the present interval has expired, the OCSS 101 then calculates the Average Waiting Time (AWT) at Block C. The AWT is found by dividing a summation of all of the Waiting Times by the total number of hall calls responded to by the elevator cars of the group. By example, if the summation of the Waiting Times for a given interval is found to be 300 seconds, and if 10 hall calls were responded to during the interval, then the AWT, for the elevator car group, equals 30 seconds for this interval.

At Block D the AWT is compared to a first, maximum threshold ($T_{MAX}$) AWT value, by example 35 seconds. If the AWT is greater than $T_{MAX}$ then the Door Dwell Time (DDT), for both hall calls and car calls, is decreased at Block E by an increment of time designated as $\Delta(t)$. By example only, $\Delta(t)$ may be fixed at 0.25 seconds. Alternatively, $\Delta(t)$ may be a fixed percentage, such as 10% of, by example, a maximum DDT or of the DDT currently in effect. As described below, $\Delta(t)$ may also be a variable or a variable percentage. The effect is to reduce the amount of time that the car expends in responding to a hall call or to a car call, thereby tending to decrease the AWT during the next interval.

At Block F a determination is made if the revised DDT is equal to or less than some minimum value of DDT for both car calls and hall calls. If NO, operation continues at Block A. If YES, the DDT is increased by $\Delta(t)$ so as not to reduce the DDT below the allowable minimum. One suitable value for a minimum DDT for car calls is two seconds, while a suitable minimum value for hall calls is six seconds. Control then returns to Block A.

If at Block D the AWT is found not to exceed $T_{MAX}$, then a further comparison is made at Block H. At Block H the AWT is compared to a second, minimum threshold ($T_{MIN}$) AWT value, by example 25 seconds.

If NO, operation continues at Block A with no adjustment being made to the DDT for the next five minute interval.

If the AWT is less than $T_{MIN}$ then the Door Dwell Time (DWT), for both hall calls and car calls, is increased at Block I by the increment of time designated as $\Delta(t)$. The effect is to increase the amount of time that the car expends in responding to a hall call or to a car call, thereby tending to increase the AWT during the next five minute interval.

At Block J a determination is made if the revised DDT is equal to or greater than some maximum value of DDT for both car calls and hall calls. If NO, operation continues at Block A with the revised DDT. If YES, the DDT is decreased by $\Delta(t)$ so as not to increase the DDT above the allowable maximum. One suitable value for a maximum DDT for car calls is four seconds, while a suitable maximum DDT value for hall calls is eight seconds. Control then returns to Block A.

The overall effect of the operation of Blocks E and I is to maintain, for a group of elevator cars, the DDT, and also the AWT, within predetermined limits. Using the exemplary limits described above, the DDT for car calls is maintained between two seconds and four seconds and the DDT for hall calls is maintained between six seconds and eight seconds, when it is desired to maintain the AWT between 25 seconds and 35 seconds.

Based on the foregoing it can be appreciated that several additional embodiments of the invention may also be provided.

By example, the method described above employs each OCSS 101 of a group to vary the group Door Dwell Time(s). However, it is also within the scope of the invention to employ a group controller, such as the group controller 17 in the aforementioned commonly assigned U.S. Pat. No. 5,024,295, issued Jun. 19, 1991, entitled "Relative System Response Elevator Dispatcher System using Artificial Intelligence to Vary Bonuses and Penalties" to K. Thangavelu, or to employ the ADSS 113, to make the AWT determination and to determine revised Door Dwell Times. The revised Door Dwell Times may be determined on a car by car basis within the group, or may be employed on a global basis by all the cars within the group.

It is also within the scope of the invention for the ADSS 113 to use historical and/or real time passenger information so as to determine the value of $\Delta(t)$ based upon predicted passenger loading. By example, during historical peak periods of a working day the value of $\Delta(t)$ may differ from the value used during historical non-peak periods. In this embodiment, the value of $\Delta(t)$ that is employed in Blocks E and I is transmitted to each of the OCSS 101 units via the ring communication bus (102, 103). The ADSS 113 may also vary the value of $\Delta(t)$ based upon real time information, such as passenger loading information obtained for, by example, several previous time intervals, such as the previous three intervals.

It is also within the scope of the invention, and still referring to FIG. 2, for the OCSS 101 to separately monitor the waiting times for hall calls received in an up direction and in a down direction, relative to a present location of the elevator car. As a result, an AWT for up hall calls and an AWT for down hall calls is separately determined and the Door Dwell Times used for responding to up hall calls and to down hall calls may be separately varied accordingly. Also, if the elevator car is provided with front and rear doors, each of which having hall calls associated therewith, the method of the invention may be employed to separately vary the DDTs for the two doors.

It is to be understood that the ranges and the preferred values of the various quantities specified above are empirical in nature and are preferably a function of the specific building configuration and its traffic patterns. As used herein, building configuration means the physical attributes of the building which impact traffic flow therethrough, including but not limited to number of floors, number of elevators, elevator speed, location of express zone(s), location of lobby level and/or parking level(s), total building population, and distribution of the population per floor.

It should further be noted that, inasmuch as the DDT for hall calls has a greater impact on system performance and response than does the typically shorter DDT for car calls, that the invention may operate so as to maintain the DDT for car calls fixed and to only vary the DDT for hall calls.

Thus, although described in the context of specific embodiments, it should be realized that a number of modifications may be made thereto. For example, in FIG. 2 certain of the steps may be executed in other than the order shown while still achieving the same result. Furthermore, the invention may be practiced with elevator systems having different architectures than that specifically shown in FIG. 1. Therefore, the invention is not intended to be limited to only the described embodiments, but is instead intended to be limited only as the invention is set forth in the claims which follow.

We claim:

1. A method of controlling Door Dwell Time for an elevator car, comprising the steps of:

providing, in response to a plurality of registered hall call signals and a corresponding plurality of car door open command signals, a corresponding plurality of wait time signals each having a magnitude indicative of an amount of time elapsed between registration of a hall call signal and a corresponding car door open command signal;

determining, over a first interval of time, in response to the plurality of wait time signals, an average amount of time that expires between a time when a hall call is received to when an elevator car door of the elevator car is commanded to open in response to the hall call for providing an average wait time signal;

determining, in response to the average wait time signal, a value of the Door Dwell Time, for providing a Door Dwell Time signal for use during a subsequent, second interval of time for controlling the Door Dwell Time; and controlling the elevator car door such that the elevator car door is open within Door Dwell Time.

2. A method as set forth in claim 1 wherein the step of determining an average amount of time is repetitively accomplished during a plurality of consecutive time intervals.

3. A method as set forth in claim 1 wherein the step of determining a value of the Door Dwell Time further includes the steps of:

comparing the average amount of time to a first threshold value and, if the average amount of time exceeds the first threshold value;

decreasing the Door Dwell Time by a predetermined time increment;

or, if the average amount of time does not exceed the first threshold value, comparing the average amount of time to a second threshold value and, if the average amount of time is less than the second threshold value; and increasing the Door Dwell Time by the predetermined time increment.

4. A method as set forth in claim 3 wherein the step of decreasing the Door Dwell Time includes an additional step of determining if the decreased Door Dwell Time is equal to or less than a predetermined minimum Door Dwell Time and, if so, increasing the Door Dwell Time so that it equals or exceeds the minimum Door Dwell Time.

5. A method as set forth in claim 3 wherein the step of increasing the Door Dwell Time includes an additional step of determining if the increased Door Dwell Time is equal to or greater than a predetermined maximum Door Dwell Time and, if so, decreasing the Door Dwell Time so that it equals or is less than the maximum Door Dwell Time.

6. A method of establishing a Door Dwell Time for an elevator car, comprising the steps of:

accumulating, over a first interval of time, in response to a plurality of hall call signals and a corresponding plurality of elevator car door open signals, a total amount of time that expires between a time when each hall call is received to when an elevator car door of a responding elevator car opens in response to the hall call, for providing a total time signal;

at the end of the interval of time, in response to the total time signal and to a hall call quantity signal having a magnitude indicative of the number of hall calls during the first interval, providing an Average Waiting Time (AWT) signal having a magnitude indicative of the total amount of time divided by the number of hall calls received during the first interval of time;

comparing the magnitude of the AWT signal to that of a first AWT threshold signal;

if the AWT signal magnitude exceeds the magnitude of the first AWT threshold signal, decreasing the magnitude of an elevator car Door Dwell Time (DDT) signal by a time increment so as to obtain a revised DDT signal magnitude for use during a second time interval; or if the AWT signal magnitude does not exceed the first AWT threshold value:

comparing the AWT signal magnitude to that of a second AWT threshold signal;

if the AWT signal magnitude is less than that of the second AWT threshold signal, increasing the elevator car DDT signal magnitude by the time increment so as to obtain a revised DDT signal magnitude for use during the second time interval; and controlling the elevator car door such that the door is open within a revised Door Dwell Time corresponding to the revised DDT signal magnitude.

7. A method as set forth in claim 6 wherein the step of decreasing is followed by a step of determining if the decreased Door Dwell Time is equal to or less than a predetermined minimum Door Dwell Time and, if so, increasing the Door Dwell Time so that it equals or exceeds the minimum Door Dwell Time.

8. A method as set forth in claim 6 wherein the step of increasing is followed by a step of determining if the increased Door Dwell Time is equal to or greater than a predetermined maximum Door Dwell Time and, if so, decreasing the Door Dwell Time so that it equals or is less than the maximum Door Dwell Time.

9. A method as set forth in claim 6 wherein the increment of time has a fixed value for each time interval.

10. A method as set forth in claim 6 wherein the increment of time has a variable value.

11. A method as set forth in claim 6 wherein the value of the increment of time is a function of elevator group response.

12. A method as set forth in claim 11 wherein the value of the increment of time is determined in accordance with historical and/or real time passenger traffic information.

13. A method as set forth in claim 11 wherein the same value of the increment of time is used by each elevator car within the group.

14. A method as set forth in claim 6 wherein if the AWT is found not to exceed the first AWT threshold value, and not to be less than the second AWT threshold value, the method includes a step of employing a current value of the DDT during the second time interval.

15. A method as set forth in claim 6 wherein the revised DDT includes a first revised DDT employed for responding to hall calls.

16. A method as set forth in claim 15 wherein the revised DDT includes a second revised DDT employed for responding to car calls.

17. Apparatus for establishing a Door Dwell Time for controlling the Door Dwell Time for an elevator car, the apparatus including elevator car control means that includes first means for determining, over a first interval of time, an average amount of time that expires between a time when a hall call is received to when an elevator car door of the elevator car is commanded to open in response to the hall call; and second means for determining, in accordance with the average amount of time, a value of the Door Dwell Time for use during a subsequent, second interval of time; said elevator car control means further including means for controlling the elevator car door of the elevator car such that the elevator car door is open within the Door Dwell Time.

18. Apparatus as set forth in claim 17 wherein said elevator car control means is associated with a specific elevator car for controlling the operation of the specific elevator car.

19. Apparatus as set forth in claim 16 wherein said elevator car control means is associated with a group of elevator cars for controlling, at least in part, the operation of each of the elevator cars within the group.

20. Apparatus as set forth in claim 17 wherein said second means includes means for varying the Door Dwell Time in accordance with a predetermined time increment, and further includes means for separately determining, for each interval of time, a value of the Door Dwell Time for use in responding to hall calls and a value of the Door Dwell Time for use in responding to car calls.

* * * * *